US006067725A

United States Patent [19]

Moser

[11] Patent Number: 6,067,725

[45] Date of Patent: May 30, 2000

[54] DRYING CUBICLE

[75] Inventor: Michel Moser, Grand Couronne, France

[73] Assignee: Shell Research Limited, United Kingdom

[21] Appl. No.: 09/091,207

[22] PCT Filed: Dec. 12, 1996

[86] PCT No.: PCT/EP96/05739

§ 371 Date: Jun. 9, 1998

§ 102(e) Date: Jun. 9, 1998

[87] PCT Pub. No.: WO97/22289

PCT Pub. Date: Jun. 26, 1997

[30] Foreign Application Priority Data

Dec. 19, 1995 [FR] France ..... 95 15042

[51] Int. Cl.[7] ..... F26B 19/00

[52] U.S. Cl. ..... 34/223; 34/225; 34/233

[58] Field of Search ..... 34/60, 90, 202, 34/221, 223, 225, 229, 233, 667; 9/449, 111.1, 111.6; 392/380, 381

[56] References Cited

U.S. PATENT DOCUMENTS

| | | | |
|---|---|---|---|
| 3,128,161 | 4/1964 | Hudon | 34/233 |
| 4,972,606 | 11/1990 | Stoltz | 34/225 X |
| 5,099,587 | 3/1992 | Jarosch | 34/225 X |
| 5,369,892 | 12/1994 | Dhaemers | 34/275 |
| 5,752,326 | 5/1998 | Trim | 34/225 X |

*Primary Examiner*—Stephen Gravini

[57] ABSTRACT

The invention relates to a personal or communal drying cubicle (1), which comprises an outer wall (2) provided with an opening (3) which can be connected up to a duct for supplying drying air, and an inner wall (4) pierced with outlet orifices (7) for distributing the drying air inside the drying cubicle (1), the outer and inner walls (2, 4), which have the shape of a portion of a cylinder, are arranged one with respect to the other in such a way as to delimit between them an internal space (6) with a substantially crescent-shaped transverse section in order to obtain a uniform distribution of the drying air through the outlet orifices (7) with a minimum drop in pressure.

5 Claims, 2 Drawing Sheets

DRYING CUBICLE

Figure 1:
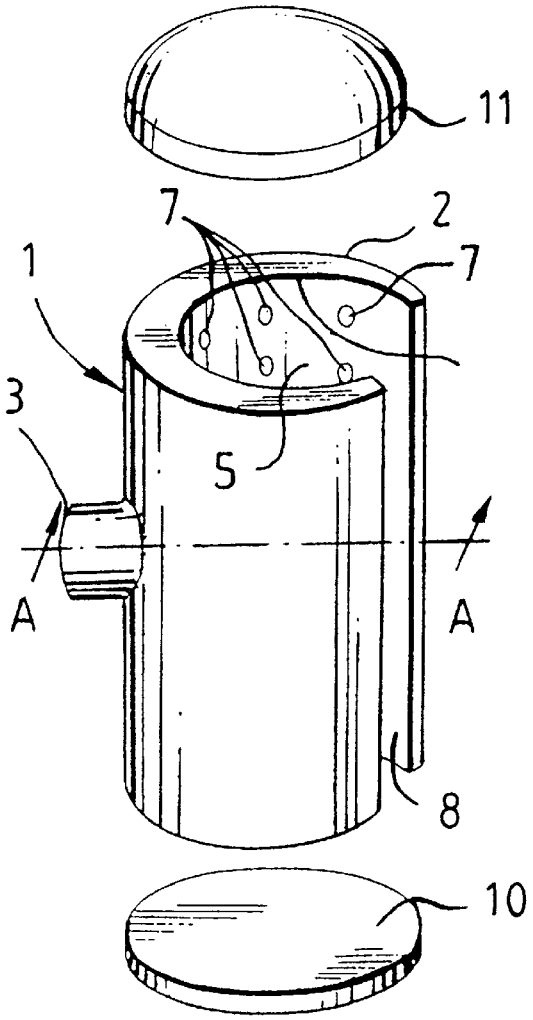

The present invention relates to a personal or communal drying cubicle.

The invention may be used in a home or in communal installations such as swimming pools, water sports centres, sports clubs, or alternatively in the hotel trade and health farms.

Shower cubicles are already known which can, in an elaborate version, be equipped with a distribution device with multiple water jets at constant temperature.

German Offenlegungsschrift No. 35 17 334 discloses a personal drying device comprising an air-distributor comprising an outer wall provided with an opening which can be connected to a duct for supplying drying air, and an inner wall pierced with outlet orifices for distributing drying air inside the cubicle.

The known drying device comprises an air-distributor which comprises two separate arms which each has a separate supply of hot air. Each of the arms is provided with a single row of outlet openings, and the arms can be moved vertically. Alternatively, the arms of the drying device can have a vertical extension which equals the length of a person.

Nothing in the German specification suggests that the drying device can have only one air supply, and that by selecting the shape of the internal space between the inner and outer walls properly a uniform distribution of the drying air through the outlet orifices with a minimum drop in pressure can be obtained.

The main objective of the present invention is therefore to produce a drying cubicle which allows uniform distribution of the drying air inside the said cubicle, while minimizing the drops in pressure head of the flow of air between the pipe supplying the drying air and orifices for distributing air inside the cubicle. Such a drying cubicle has also to have a small size, low manufacturing costs, and be relatively easy to maintain.

In particular, the hygiene and safety of users of such a cubicle have to be fully ensured.

To this end the drying cubicle according to the invention is characterized in that the outer wall is provided with a single opening and in that the outer and inner walls are arranged one with respect to the other in such a way as to delimit between them an internal space with a substantially crescent-shaped transverse section in order to obtain a uniform distribution of the drying air through the outlet orifices with a minimum drop in pressure.

Indeed, such a drying cubicle is designed so that the variation in the crescent-shaped transverse section of the internal space, determined as a function of the inlet pressure of the drying air to the internal space, the distribution and the surface area of the outlet orifices in the inner wall, makes it possible to obtain a uniform distribution of the flows of drying air into the drying cubicle via the outlet orifices with a minimum drop in pressure.

In this way a simple and effective solution with only one air supply is obtained.

Reference is made to International patent application publication No. 91/07 900 relating to a dryer comprising a hot air generator connected to a hand-held distributor by means of an elongated flexible hose. This publication is not relevant to the present invention because it is concerned with a hand-held distributor. Reference is further made to U.S. Pat. No. 4 871 900, which publication discloses an air dryer comprising a flexible skirt which is suspended from a circular header and which is provided with several elongated vertical flexible chambers, wherein each chamber has several side openings which are provided with a nozzle for directing the air flow and communicates with the circular header. This publication discloses that the drying air flows vertically from the circular header through each of the vertical flexible chambers, and thus in one dimension only. Therefore this publication is not relevant to the present invention. Reference is finally made to International patent application publication No. 95/02 984, which relates to a drying cabin having a side wall and means for introducing drying air at the top of the drying cabin in such a way the drying air can swirl along the inner surface of the side wall. This publication is not relevant to the present invention, because it is concerned with a drying cabin in which the drying air is supplied at the top and not at the sides.

According to a particularly advantageous embodiment of the drying cubicle according to the invention, the outlet orifices in the inner wall are circular in shape and have an area and are distributed over the surface of the inner wall such as to ensure a distribution of turbulent flows of drying air inside the drying cubicle, allowing quick and effective drying.

According to one embodiment, the drying cubicle in accordance with the invention includes a base and a ceiling which can be joined to the walls to give the drying cubicle good mechanical rigidity, the base and the ceiling each being provided with grooves in which the inner and outer walls are mounted slidingly.

In this way, the drying cubicle according to the invention has good mechanical rigidity ensuring that it is stable even when subjected to the combined thrust of a number of people.

What is more, such an assembly of the inner and outer walls sliding on the base and the ceiling gives easy access to the internal space provided between the outer and inner two walls of the drying cubicle. This makes it easier to clean this space and allows regular inspections making it possible to check that the drying cubicle is working.

Advantageously, the outer and inner walls of the drying cubicle in accordance with the present invention are produced by moulding from a plastic.

The plastic used may be polyester which has good flame resistance and good resistance to the giving-off of fumes, and is therefore able to provide good thermal safety. The use of such a material makes it possible to maintain the mechanical integrity of the drying cubicle up to a temperature of the order of 120° C, which temperature will never be reached in the particular application of personal or communal drying.

Figure 2:
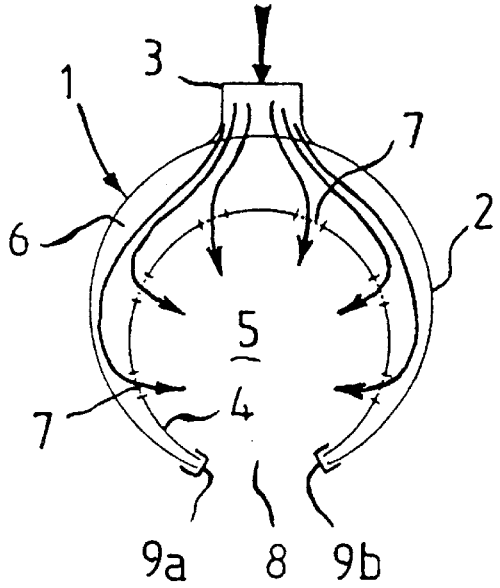
Figure 3:
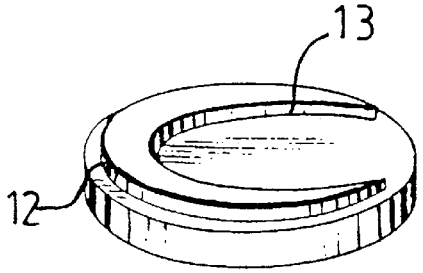
Figure 4:
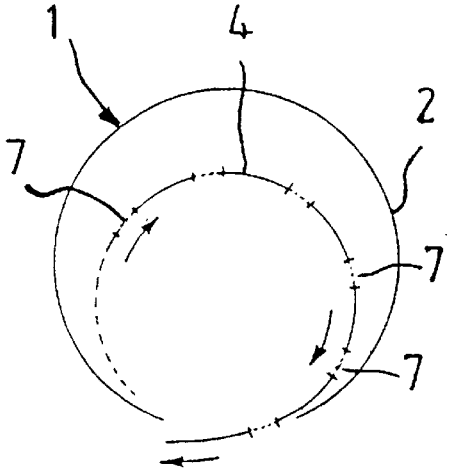
Figure 5:
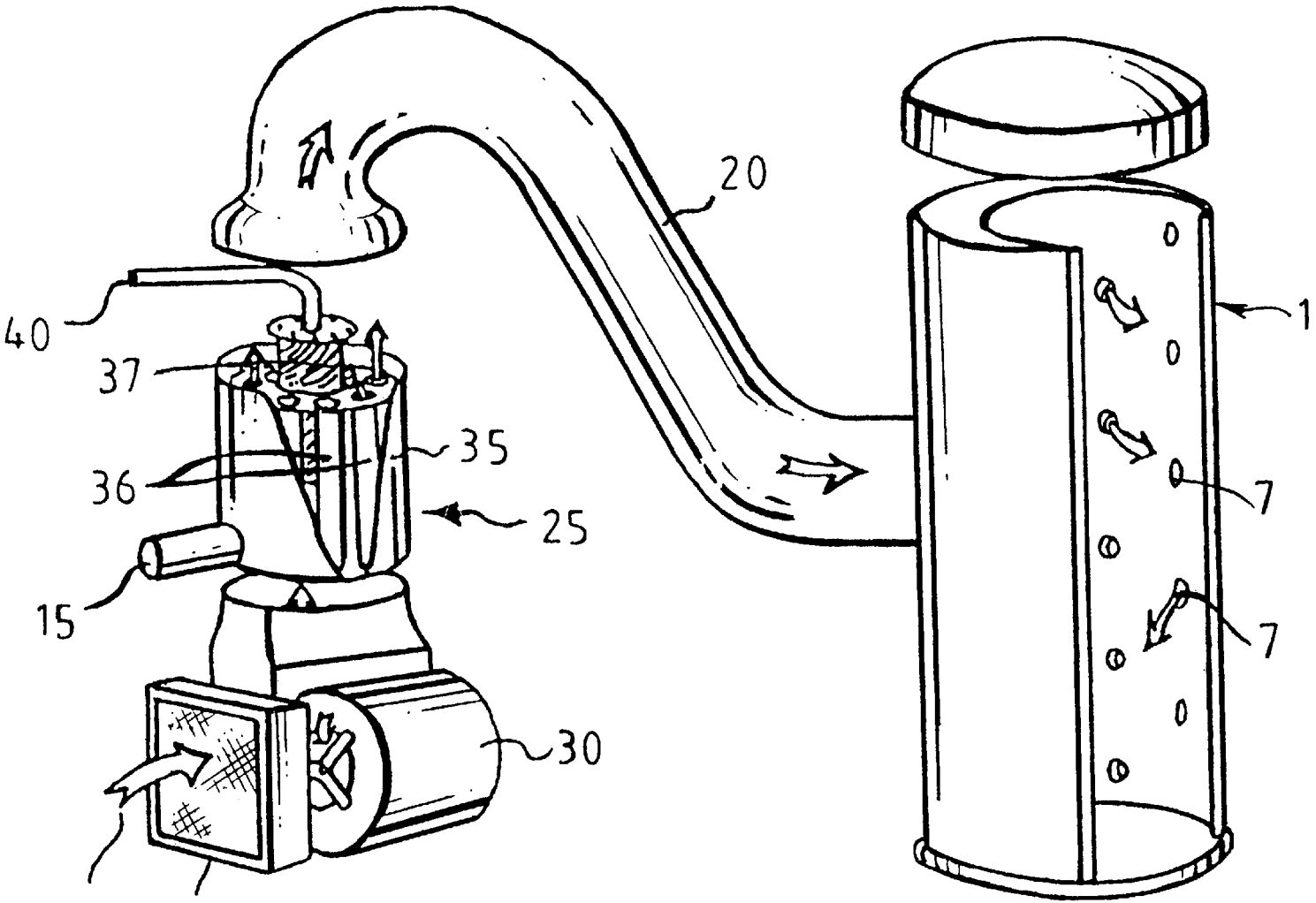

The description which will follow with reference to the attached drawings, given by way of non-limiting examples, will make it easy to understand in what the invention consists, and how it may be achieved. In the attached drawings:

FIG. 1 is a diagrammatic view in exploded perspective of the drying cubicle according to the invention, FIG. 2 is a view in section on the plane A—A of the cubicle represented in FIG. 1, FIG. 3 is a diagrammatic detail view of the base of the cubicle according to the invention, and FIG. 4 is a diagrammatic view from above representing the removal of the inner wall of the cubicle according to the invention, FIG. 5 is a diagrammatic overall exploded view of the drying cubicle according to the invention connected up via an air-supply duct, to a hot-air generator.

Represented in FIGS. 1 and 2 is a personal or communal drying cubicle 1 which includes an outer wall 2 substantially in the shape of a portion of a cylinder. This outer wall 2 comprises an opening 3, here positioned halfway up. As an alternative, provision may of course be made for the opening 3 to be placed at the top of the drying cubicle 1. This opening 3 can be connected up to a duct for supplying drying air (not shown).

The outer wall 2 has the shape of a portion of a cylinder, for example a portion of an axisymmetric cylinder, or a portion of an elliptical cylinder. The drying cubicle also includes an inner wall 4 which also has the shape of a portion of an axisymmetric or elliptical cylinder, for example. The inner wall 4 delimits the drying space 5, and the outer wall 2 and the inner wall 4 define an internal space 6.

This inner wall 4 is pierced with a plurality of outlet orifices 7. They are uniformly distributed over the entire surface of the inner wall 4. The outlet orifices 7 allow the passage of the hot drying air introduced at a certain inlet pressure through the opening 3 and flowing through the internal space 6, so as to distribute the drying air inside the drying cubicle 1.

To this end, it will be noted that according to an essential feature of the drying cubicle in accordance with the invention, the outer wall 2 and inner wall 4 of the drying cubicle 1 are arranged so as to define between them an internal space 6 which has a substantially crescent-shaped transverse section.

As best shown in FIG. 2, this relative position of the outer wall 2 and of the inner wall 4, determined as a function of the inlet pressure of the drying air into the internal space 6, and the distribution and/or the shape of the outlet orifices 7 in the inner wall 4, makes it possible to obtain a circulation of the hot air with a small drop in pressure inside the internal space 6, and a uniform distribution of the hot air via the outlet orifices 7 in the inner wall 4 inside the drying cubicle 1.

The outlet orifices 7 for this purpose are preferably of circular shape with an area and arrangement which are designed so as to provide within the drying cubicle 1 the turbulent air necessary for quick and effective drying.

Provision may be made for the outlet orifices 7 to be directable, adjustable, or able to be sealed off in order to alter as much as necessary the flow of hot air inside the drying cubicle 1.

It will be noted that the outer and inner wall 2 and 4 meet towards the front of the drying cubicle 1 so as to form an entry 8 into the drying cubicle 1. This entry may or may not be fitted with a door.

The outer and inner wall 2 and 4 of the drying cubicle 1 are held together by means of end uprights 9*a* and 9*b*, each upright being positioned at each end of the internal space 6, straddling the two ends of the inner and outer walls 2 and 4, so as to close the internal space 6 at this point. The end uprights 9*a* and 9*b* are connected by screws to the outer and inner walls 2 and 4.

The drying cubicle 1 further includes a base 10 and a ceiling 11. The outer and inner two walls 2 and 4 of the drying cubicle 1 are mounted on the base 10 and surmounted by the ceiling 11. The ceiling 11 and the base 10 make it possible to provide the drying cubicle 1 with good mechanical strength and thus with the stability to withstand the pressures and mechanical loadings which arise out of its communal use.

In order to allow the said drying cubicle to be dismantled easily in order to have access to the internal space formed between the inner and outer two walls, the base 10 and the ceiling 11 include grooves 12 and 13 in the form of portions of a circle or alternatively portions of an ellipse depending on the shape of the outer and inner walls, in which grooves the said outer and inner walls are mounted by sliding.

Thus, as represented in FIG. 4, the outer wall 2 or the inner wall 4 can very easily be removed, for example to clean the drying cubicle 1. Removal takes place by first of all removing the two end uprights 9*a* and 9*b* then by sliding one of the walls (for example the inner wall 4) in its corresponding groove.

After cleaning, the wall can be put back on the base by sliding in the opposite direction.

The ceiling 11 advantageously comprises arrangements for taking various accessories which are, for example:

an infra-red cell or any other device making it possible to detect human presence and to command the drying cycle;

a conventional or optical-fibre lighting device. In the case of a conventional lighting device, the electrical installation needs to comply with use in damp atmospheres. The use of optical fibres with a light generator placed outside of the drying cubicle and inaccessible to those using it may prove to be a good solution to the problems of use in a damp atmosphere;

equipment for providing sound;

a device for diffusing background scent.

The outer and inner walls of the drying cubicle are advantageously made by moulding of a plastic which has good flame resistance and good resistance to the giving-off of fumes, for example polyester. The use of such a material makes it possible to maintain the mechanical integrity of the cubicle heated up to temperatures of as much as 120° C., such a temperature never being reached when the cubicle is in normal use.

The drying air may be provided by a hot-air generator of the type as described in French patent application No. 93 10 851. As can be seen from FIG. 5, the drying cubicle 1 is connected by means of conduit 20 to a hot-air generator 25. The hot-air generator 25 comprises an air inlet 26, connected via an air filter 28 to a ventilator 30. The ventilator 30 sends the air towards a heat exchanger 35, where the air is heated in tubes 36. Hot air is passed from the heat exchanger 35 through conduit 20 to the drying cubicle .1. The hot-air generator 25 further comprises a burner 37 having a supply conduit 40 for supplying air and fuel to the burner 37.

The exhaust of the burner 37 passes through the shell side of the heat exchanger 35 and is removed through outlet conduit 15.

What is claimed is:

1. A personal or communal drying cubicle comprising:

an outer wall having a curved shape;

an inner wall in spaced relationship to said outer wall, said outer and inner walls defining an internal space there between, said internal space being essentially crescent-shaped in cross-section, said inner wall having a plurality of holes therein adapted to be in fluid communication with said internal space and a drying space wherein said plurality of holes in said inner wall are air outlet orifices for directing air from said internal space into said drying space and wherein said outlet orifices are adapted to be partially or totally closed;

an opening in said outer wall, said opening adapted to be in fluid communication with said internal space, said opening adapted to be connected to a source of air;

a base for receiving the lower edges of said outer and inner walls in a fixed, spaced, relationship thereby defining said crescent-shaped cross-section; and a ceiling for covering the upper edges of said outer and inner walls in said fixed, spaced, relationship, said inner wall, base and ceiling defining said drying space therewithin;

wherein said outer and inner walls are adapted to be joined at their respective ends and wherein said joined ends are in a spaced relationship from each other when held in place by said base and said ceiling thereby providing an entryway into said drying space of said cubicle.

2. The cubicle of claim 1, wherein said ceiling includes means for detecting the presence of a body within said drying space.

3. The cubicle of claim 1, wherein said ceiling includes means for providing sound to said drying space.

4. The cubicle of claim 1, wherein said ceiling includes means for providing light to said drying space.

5. The cubicle of claim 1, wherein said ceiling includes means for diffusing background scent within said drying space.

* * * * *